US008967282B2

(12) United States Patent
Dreher, Jr. et al.

(10) Patent No.: US 8,967,282 B2
(45) Date of Patent: Mar. 3, 2015

(54) ENHANCED BITUMEN RECOVERY USING HIGH PERMEABILITY PATHWAYS

(75) Inventors: Wayne Reid Dreher, Jr., College Station, TX (US); Tawfik Nasr, Katy, TX (US); Wendell Menard, Katy, TX (US); Thomas J. Wheeler, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 658 days.

(21) Appl. No.: 13/046,149

(22) Filed: Mar. 11, 2011

(65) Prior Publication Data

US 2011/0232903 A1 Sep. 29, 2011

Related U.S. Application Data

(60) Provisional application No. 61/318,673, filed on Mar. 29, 2010.

(51) Int. Cl.
*E21B 43/27* (2006.01)
*E21B 43/30* (2006.01)

(52) U.S. Cl.
CPC ..... *E21B 43/305* (2013.01)
USPC ..... 166/400; 166/270.1; 166/272.2; 166/272.3

(58) Field of Classification Search
USPC ..... 166/270, 270.1, 272.2, 270.3, 400
See application file for complete search history.

(56) References Cited

U.S. PATENT DOCUMENTS 2,434,239 A 1/1948 Zublin
4,124,074 A * 11/1978 Allen et al. ..... 166/278
4,750,561 A * 6/1988 Dickinson et al. ..... 166/278
6,230,814 B1 5/2001 Nasr et al.
6,305,472 B2 * 10/2001 Richardson et al. ..... 166/305.1
6,662,872 B2 12/2003 Gutek et al.

(Continued)

FOREIGN PATENT DOCUMENTS

CA 2108723 4/1995
WO 2009014586 1/2009

OTHER PUBLICATIONS

Vogel, "How Solvent Vapors Can Improve Steam Floods", World Oil, Nov. 1996, 3 pages.

(Continued)

*Primary Examiner* — Zakiya W Bates
*Assistant Examiner* — Silvana Runyan
(74) *Attorney, Agent, or Firm* — ConocoPhillips Company

(57) ABSTRACT

Heavy oil recovery from oil sand reservoirs is enhanced through the creation of subsurface high permeability pathways distributed throughout the oil sand reservoirs. The high permeability pathways may be boreholes that extend through the oil sand reservoir. A portion of the high permeability pathway may be packed with high permeability particulate to provide structural support and allow for high permeability throughout the boreholes. After establishing the high permeability pathways throughout the oil sand reservoir, solvent may be introduced into the oil sand reservoir. The solvent has the beneficial effect of lowering the viscosity of the heavy oil, which aids in the extraction of the heavy oil. Thermal recovery processes and other enhancements may be combined with these methods to aid in reducing the viscosity of the heavy oil. Advantages of these methods include, accelerated hydrocarbon recovery, higher production efficiencies, lower costs, and lower extraction times.

33 Claims, 4 Drawing Sheets

(56) References Cited

U.S. PATENT DOCUMENTS

| | | | | |
|---|---|---|---|---|
| 6,769,486 | B2 * | 8/2004 | Lim et al. | 166/263 |
| 7,422,063 | B2 | 9/2008 | Crichlow | |
| 7,464,756 | B2 | 12/2008 | Gates et al. | |
| 7,527,096 | B2 | 5/2009 | Chung et al. | |
| 7,591,306 | B2 | 9/2009 | Hocking | |
| 2003/0062159 | A1 * | 4/2003 | Nasr | 166/272.1 |
| 2005/0072567 | A1 * | 4/2005 | Steele et al. | 166/272.3 |
| 2006/0113218 | A1 | 6/2006 | Hart et al. | |
| 2008/0093260 | A1 | 4/2008 | Koseoglu | |
| 2008/0139418 | A1 | 6/2008 | Cioletti et al. | |
| 2008/0190816 | A1 | 8/2008 | Dana et al. | |
| 2010/0012331 | A1 * | 1/2010 | Larter et al. | 166/401 |
| 2010/0206555 | A1 * | 8/2010 | Menard et al. | 166/245 |

OTHER PUBLICATIONS

Yasdani & Maini, "Further Investigation of Drainage Height Effect on Production Rate in VAPEX," SPE 101684 (2006), 14 pages.

Brown, "Economic Downturn Slows Heavy Oil Developments," Petroleum Africa, Jul. 2009, 4 pages.

PCT Notification of Transmittal of the International Search Report and Written Opinion of the International Searching Authority, Mar. 15, 2011, 17 pages.

* cited by examiner

FIG. 1B
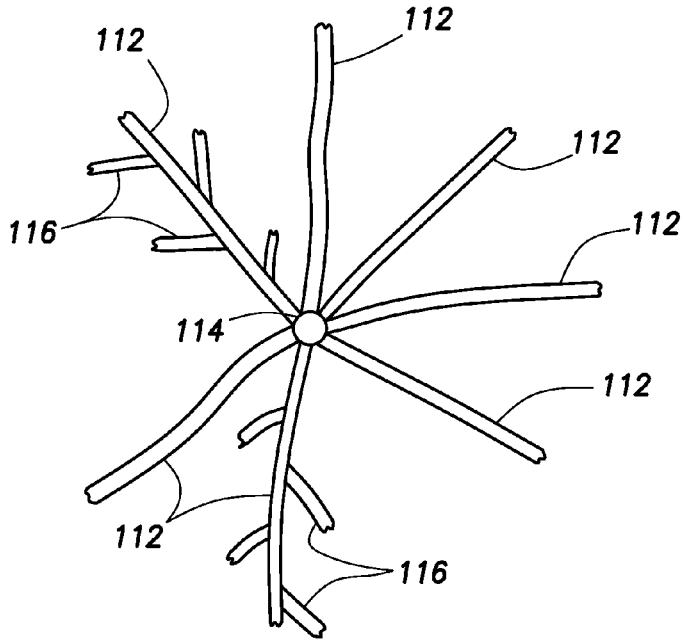
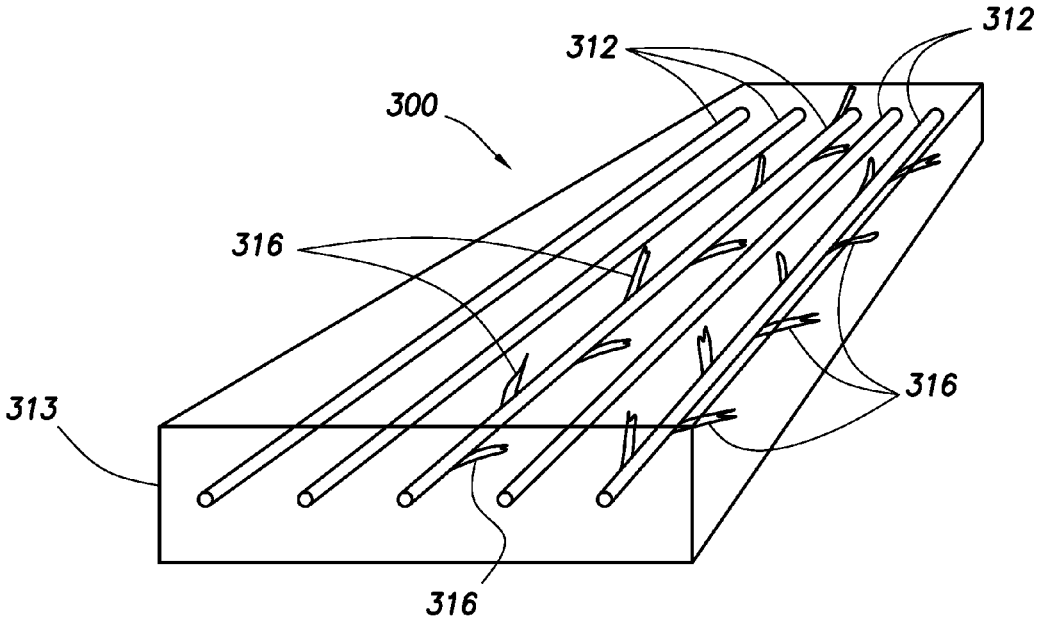
FIG. 3A

ENHANCED BITUMEN RECOVERY USING HIGH PERMEABILITY PATHWAYS

CROSS-REFERENCE TO RELATED APPLICATIONS

This application is a non-provisional application which claims the benefit of and priority to U.S. Provisional Application Ser. No. 61/318,673 filed Mar. 29, 2010, entitled "Enhanced Bitumen Recovery Using High Permeability Pathways," which is hereby incorporated by reference in its entirety.

FIELD OF THE INVENTION

The present invention relates generally to methods and systems for enhancing recovery of heavy oil from oil sand reservoirs. More particularly, but not by way of limitation, embodiments of the present invention include methods and systems for enhancing recovery of viscous heavy crude oil such as bitumen from thin reservoirs by creating subsurface high permeability pathways.

BACKGROUND

The production of viscous heavy oil from subsurface reservoirs presents significant challenges. For example, some heavy crude oils, such as bitumen, are highly viscous and therefore immobile at the initial viscosity of the oil at reservoir temperature and pressure. Indeed, such heavy oils may be quite thick and have a consistency similar to that of peanut butter or heavy tars, making their extraction from the reservoir especially challenging.

Conventional approaches to recovering such heavy oils focus on methods for lowering the viscosity of the heavy oil so that the heavy oil may be produced from the reservoir. One example of a conventional method for recovering heavy oil is surface mining. Surface mining may be infeasible or at least highly inefficient under certain circumstances, such as when the desired hydrocarbons are not located near the surface. Additionally, in some of the conventional approaches, surface mining may require significant surface reconstitution.

Another example of a conventional method for recovering heavy oil is heating the reservoir to lower the viscosity of the heavy oil. Commonly used in-situ extraction thermal recovery techniques include a number of reservoir heating methods, such as steam flooding, cyclic steam stimulation, and steam assisted gravity drainage (SAGD). Steam flooding involves the use of injected steam to heat and physically displace hydrocarbons to encourage production of the hydrocarbons. Cyclic steam stimulation, also known as the huff and puff method, involves three stages, injection, soaking, and production. Steam is first injected into a well for a certain amount of time to heat the oil in the surrounding reservoir to a temperature at which it flows. After a sufficient injection of steam, the steam is usually left to "soak" for some time afterward (typically not more than a few days). Then oil may be produced out of the same well. Steam assisted gravity drainage, on the other hand, involves continuously injecting steam into an upper wellbore to heat the surrounding heavy crude oil and reduce its viscosity, causing the heated oil to drain into a lower wellbore, where it may be pumped out.

These conventional approaches are highly disadvantageous in that they are all significantly energy intensive. In some cases, these thermal recovery techniques are so inefficient that they are often non-economically viable for recovering heavy crude oil. Indeed, these conventional thermal recovery techniques are especially economically disadvantageous as applied to thin bitumen reservoirs (e.g. bitumen reservoirs having a thickness less than about 15 meters). The inefficiency of these various methods in thin bitumen reservoirs is in part due to the fact that heat applied to the reservoir can be lost to the over-burden or the under-burden, that is, geological material that lies above or below an area of economic interest. This heat loss to the over-burden and under-burden along with other factors such as well cost and well spacing makes conventional thermal recovery methods economically infeasible as applied to thin zone reservoirs.

Another conventional method for enhancing recovery of heavy crude oil is the use of solvents for dissolution to assist in the recovery of heavy crude oil. Unfortunately however, solvents can be quite expensive, and therefore, the process economics are highly sensitive to solvent cost and losses. Solvent losses increase in thin reservoirs, where solvent can become stranded due to reservoir heterogeneities and bypassed in the recovery process.

Accordingly, there is a need for enhanced recovery methods for heavy crude oil such as bitumen that address one or more of the disadvantages of the prior art.

SUMMARY

The present invention relates generally to methods and systems for enhancing recovery of heavy oil from oil sand reservoirs. More particularly, but not by way of limitation, embodiments of the present invention include methods and systems for enhancing recovery of viscous heavy crude oil such as bitumen from thin reservoirs by creating subsurface high permeability pathways.

One example of a method for enhancing recovery of bitumen from a thin reservoir comprises establishing a distribution of high permeability pathways in a thin reservoir wherein the step of establishing comprises drilling a plurality of boreholes through the thin reservoir, each borehole having a diameter and each borehole being an openhole, wherein the thin reservoir is nonconsolidated and wherein the thin reservoir has a thickness of less than or equal to about 15 meters; packing a longitudinal portion of each borehole with a high permeability particulate such that the high permeability particulate substantially occupies the entire diameter of the borehole; wherein at least one of the high permeability pathways comprises an injection wellbore; wherein at least one of the high permeability pathways comprises a production wellbore; introducing a solvent into the injection wellbore; allowing the solvent to flow into the thin reservoir and mix with the bitumen to form a mixture of the bitumen and the solvent; withdrawing the mixture from the thin reservoir from the production wellbore; conditioning the thin reservoir over a period of time by allowing a continuous fluid circulation to develop from the injection wellbore to the production wellbore; and after the step of conditioning the thin reservoir, continuously introducing the solvent into the thin reservoir by way of at least one of the high permeability pathways the while simultaneously withdrawing the mixture from the thin reservoir.

One example of a method for enhancing recovery of bitumen from a thin reservoir comprises the steps of: establishing a plurality of high permeability pathways that traverse at least partially through the thin reservoir, wherein the thin reservoir is nonconsolidated and wherein the thin reservoir has a thickness of less than or equal to about 15 meters; wherein each high permeability pathway comprises a borehole, wherein the borehole is substantially packed with high permeability particulate; introducing a solvent into one of the high permeability pathways; allowing the solvent to flow into the thin reservoir and mix with the bitumen to form a mixture of the bitumen and the solvent; and withdrawing the mixture from the thin reservoir from one of the high permeability pathways.

A method for enhancing recovery of heavy oil from an oil sand reservoir comprises the steps of: establishing a plurality of high permeability pathways that traverse at least partially through the oil sand reservoir, wherein the thin reservoir is nonconsolidated and wherein the oil sand reservoir has a thickness of less than or equal to about 15 meters; wherein each high permeability pathway comprises a borehole, wherein the borehole is substantially packed with high permeability particulate; wherein at least one of the high permeability pathways comprises an injection wellbore; wherein at least one of the high permeability pathways comprises a production wellbore; introducing a solvent into the injection wellbore; allowing the solvent to flow into the oil sand reservoir and mix with the heavy oil to form a mixture of the heavy oil and the solvent; withdrawing the mixture from the production wellbore; and establishing continuous fluid communication between the injection wellbore and the production wellbore.

The features and advantages of the present invention will be apparent to those skilled in the art. While numerous changes may be made by those skilled in the art, such changes are within the spirit of the invention.

BRIEF DESCRIPTION OF THE DRAWINGS

A more complete understanding of the present disclosure and advantages thereof may be acquired by referring to the following description taken in conjunction with the accompanying figures, wherein:

FIG. 1B illustrates an example of a top view of an enhanced heavy oil recovery system having high permeability pathways configured in a spoke configuration in accordance with one embodiment of the present invention.

FIG. 3A illustrates a perspective view of a plurality of high permeability pathways extending through an oil sand reservoir in accordance with one embodiment of the present invention.

Figure 1A:
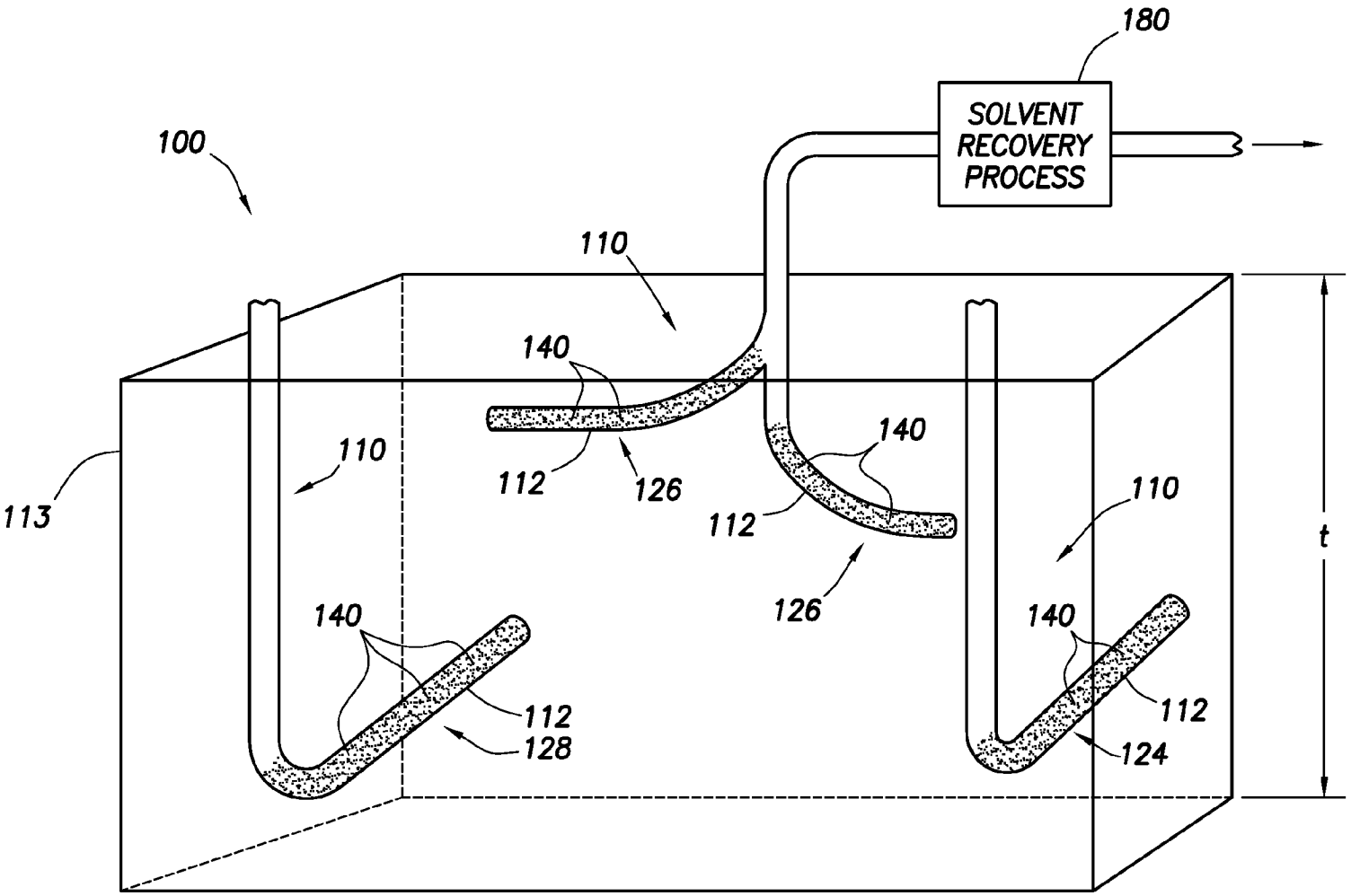
FIG. 1A illustrates an example of an enhanced heavy oil recovery system having a plurality of high permeability pathways distributed throughout an oil sand reservoir in accordance with one embodiment of the present invention.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

The present invention relates generally to methods and systems for enhancing recovery of heavy oil from oil sand reservoirs. More particularly, but not by way of limitation, embodiments of the present invention include methods and systems for enhancing recovery of viscous heavy crude oil such as bitumen from thin reservoirs by creating subsurface high permeability pathways.

In certain embodiments, a plurality of high permeability pathways is distributed throughout an oil sand reservoir. The high permeability pathways may be boreholes that extend through the oil sand reservoir. A portion of the high permeability pathway may be packed with high permeability particulate to provide structural support to the borehole and to allow for high permeability throughout the boreholes. After establishing the high permeability pathways throughout the oil sand reservoir, solvent may be introduced into the oil sand reservoir and allowed to mix with any heavy oil in the reservoir. The solvent has the beneficial effect of lowering the viscosity of the heavy oil, which aids in the extraction of the heavy oil.

A number of other variations and enhancements are described below. One example of an enhancement that may be used in conjunction with the methods herein is the integration of thermal recovery processes to aid in reducing the viscosity of the heavy oil.

Advantages of such enhanced heavy oil recovery processes include, but are not limited to, accelerated hydrocarbon recovery, higher production efficiencies, and lower costs. These advantages ultimately translate to higher production and/or reduction of total extraction time of in-situ hydrocarbons. The methods disclosed herein are particularly advantageous in thin reservoirs (e.g. reservoirs having a thickness less than or equal to about 15 meters), because conventional methods suffer from a variety of disadvantages when applied to thin reservoirs due in part to the energy losses to the under or over burden of the thin reservoirs.

Reference will now be made in detail to embodiments of the invention, one or more examples of which are illustrated in the accompanying drawings. Each example is provided by way of explanation of the invention, not as a limitation of the invention. It will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations that come within the scope of the invention.

FIG. 1 illustrates an example of an enhanced heavy oil recovery system having a plurality of high permeability pathways distributed throughout an oil sand reservoir in accordance with one embodiment of the present invention.

Wellbores 110 are distributed throughout oil sand reservoir 113. Each of these wellbores 110 extends at least partially through oil sand reservoir 113. Portions of wellbores 110 may be packed with high permeability particulate 140 (e.g. gravel) to provide structural support for each wellbore as desired. As oil sand reservoirs are often formed of unconsolidated sand, high permeability particulate 140 may be necessary to prevent collapse of wellbores 110. High permeability particulate 140 may be sized to provide for high permeability through wellbores 110. In this way, each wellbore 110 becomes a high permeability pathway 112 through oil sand reservoir 113.

As shown in FIG. 1, wellbores 110 may be distributed throughout oil sand reservoir 113 to form a distribution 100 of high permeability pathways 112 for accessing heavy oils stored in oil sand reservoir 113 and for introducing solvents and/or heating agents into oil sand reservoir 113.

Typically, before application of the enhanced recovery methods described herein, the initial viscosity of heavy oil in oil sand reservoir 113 is sufficiently high that the heavy oil is relatively immobile or difficult to produce. Solvent may be introduced in any one or more of high permeability pathways 112 for mixing with any heavy oils in oil sand reservoir 113. Because of the relative immobility of the heavy oil therein, any solvent initially introduced into oil sand reservoir 113 may have limited penetration into oil sand reservoir 113. Nevertheless, some of the solvent will mix with some of the heavy oil to form a mixture at least to a certain limited penetration distance into oil sand reservoir 113. This resulting mixture of solvent and heavy oil can be extracted and produced from oil sand reservoir 113.

This process of introducing solvent and withdrawing the resulting mixture can be repeated a number of times, resulting in increasing penetration into the oil sand reservoir. Withdrawal of the mixture may leave void spaces in the reservoir in the space previously occupied by the mixture. In this way, the solvent may extend farther into the oil sand reservoir with each successive cycle of introducing solvent followed by withdrawal of the resulting mixture. In certain reservoirs, this cyclical solvent treatment of the reservoir may then allow fluid channels to develop extending from the wellbore throughout the formation.

Over time, the radius of solvent penetration from one wellbore may extend to or overlap with the solvent penetration from an adjacent wellbore. This conditioning of the oil sand reservoir in this way may thus establish fluid communication between two or more wells. Upon establishing fluid communication between adjacent wells, the batch cyclical process of introducing solvent followed by withdrawal of the resulting mixture may be converted to a continuous process, if desired. That is, solvent may be continuously introduced into one of the high permeability pathways, e.g. injection wellbore 126, while simultaneously withdrawing the mixture of solvent and heavy oil from an adjacent high permeability pathway, e.g. production well bore 124 or 128.

Any solvent may be used that provides some dissolution of the heavy oil and/or lowering of the viscosity of the heavy oil. Examples of solvents suitable for use in conjunction with the present invention include, but are not limited to, a wide variety of condensing solvents including C4-C30 or mixtures thereof, naptha, diluent, syncrude, diesel, aromatic solvents such as toluene, benzene, and xylene, and any other solvent known in the art, or any combination thereof. In certain embodiments, emulsifying agents such as surfactants may be used separately or in combination with one or more of the solvents. In certain embodiments, the solvent may be heated prior to or during introduction of the solvent to the oil sand reservoir to further lower the viscosity of the heavy oil.

Solvent may be recovered from the mixture withdrawn from oil sand reservoir 113 by solvent recovery process 180, which in certain embodiments may be a flash drum, one or more distillation columns, any suitable process separations technology, or any combination thereof. In certain embodiments, the recovered solvent may be recycled back to the oil sand reservoir for additional use.

Other heated fluids may also be introduced downhole for applying heat to the oil sand reservoir or heavy oil therein. For example, steam may be introduced into one or more of the high permeable pathways to heat the heavy oil. These heated fluids such as steam may be introduced in combination with or separately from the solvent. Additionally, the steam or steam/solvent mixture may be introduced cyclically, continuously, alternatively, or any combination thereof through any of the high permeable pathways as desired.

Any one or more of the high permeability pathways may be used as an injection wellbore or a production wellbore as desired. Additionally, it is recognized that any high permeability pathway may alternatively serve as an injection wellbore and a production wellbore. Further, any one or more of the high permeability pathways may be used as a supplemental injection wellbore, such as for example supplemental injection wellbore 128 for introduction of heating fluids or other treatment fluids that may assist with hydrocarbon extraction.

It is recognized that although the methods disclosed herein may be used in any heavy oil reservoir, the methods disclosed herein may be particularly advantageous for use in thin reservoirs. The term, "thin reservoirs," as used herein refers to reservoirs having thicknesses equal or less than about 15 meters. FIG. 1 shows such an oil sand reservoir 113, having a thickness t, which in this case is less than about 15 meters. In certain embodiments, methods herein may be used in thin reservoirs having thicknesses from about 2 meters to about 15 meters. The methods disclosed herein may also be particularly advantageous over conventional methods when applied to heavy oil/bitumen reservoirs and/or unconsolidated formations.

Wellbores 110 may be completed in a number of configurations and arrangements. In certain embodiments, wellbores 110 will extend substantially vertically to the desired depth of the oil sand reservoir and then extend horizontally or in an otherwise deviated fashion through the oil sand reservoir. For convenience of reference herein, vertical refers to any vector substantially parallel to the gravity vector, whereas horizontal refers to any vector substantially perpendicular thereto. Often, a vertical portion of wellbore 110 will be completed with cemented casing whereas horizontal or substantially deviated portions of wellbore 110 will be left as an openhole borehole. For structural stability of the openhole, wellbore 110 may be packed with high permeability particulate along a portion of wellbore 110, e.g. high permeability pathway 112. In certain embodiments, wellbore 110 may be backfilled with high permeability particulate 140 during completion so as to form high permeability pathway 112. Alternatively, a slotted liner could be used in conjunction with or in place of high permeability particulate 140.

Suitable high permeability particulates include, but are not limited to, sand, sintered bauxite, silica alumina, glass beads, or any combination thereof. Other suitable high permeability particulates include, but are not limited to, sand, bauxite, ceramic materials, glass materials, polymer materials, polytetrafluoroethylene materials, nut shell pieces, seed shell pieces, fruit pit pieces, wood, composite particulates, proppant particulates, gravel, and combinations thereof. Suitable particulates may take any shape including, but not limited to, the physical shape of platelets, shavings, flakes, ribbons, rods, strips, spheroids, ellipsoids, toroids, pellets, or tablets. Although a variety of particulate sizes may be useful in the present invention, in certain embodiments, particulate sizes greater than about 500 microns are preferred, and in still other embodiments, particulate sizes greater than about 1,000 microns is preferred. In certain embodiments, a substantial uniformity and homogeneity of particulate size is desired to maintain the relatively high permeability of each high permeability pathway.

In addition to or in place of a portion of the high permeability particulates, catalyst particulates may be used. Specific catalysts which facilitate upgrading for this process will ideally be less susceptible to poisoning by sulfur species, water oxidation, nitrogen or heavy metal poisoning or other forms of potential transition metal catalyst poisoning.

Examples of hydroprocessing catalysts suitable for use with the present invention include, but are not limited to, metal sulfides (e.g. $MoS_2$, $WS_2$, CoMoS, NiMoS), metal carbides (e.g. MoC, WC), or other refractory type metal compounds such as metal phosphides, borides, or any hydroprocessing catalyst known in the art. Additionally, any combination of the foregoing may be used. It is not anticipated that reduced metal catalysts will remain active for a long period of time in this application. Typical hydroprocessing types of reaction comprise impurity removal processes, such as the removal of sulfur, nitrogen and metals. These reactions can improve the ultimate quality of the crude. Hydrogen assisted removal of oxygen can lower the acid number of the crude. Reduction of aromatics will produce "lighter" hydrocarbons thus lowering the API gravity of the crudes. Potential hydrocracking/isomerization reactions can provide lower carbon number branched hydrocarbons and will improve a lower viscosity crude. Some combination of all the above reactions may be realized so as to provide an improved quality and less viscous crude.

FIG. 1B illustrates an example of a top view of an enhanced heavy oil recovery system having high permeability pathways configured in a "hub and spoke" configuration in accordance with one embodiment of the present invention. Here, central wellbore 114 is shown from an aerial perspective with a plurality of high permeability pathways 112 extending therefrom into a thin reservoir. One or more of the high permeability pathways 112 may be configured with one or more branches 116 to increase the production enhancement of the thin reservoir.

In certain embodiments, each high permeability pathway 112 may have branches 116 extending therefrom, whereas other embodiments may alternate with and without branches 116 while still other embodiments will include branches 116 only as desired. Branches may extend at angles from each high permeability pathway 112 from about 40° to about 85° in some embodiments. This "hub and spoke" configuration" may optimize recovery of bitumen and other heavy oils from thin reservoirs in certain embodiments.

Figure 2:
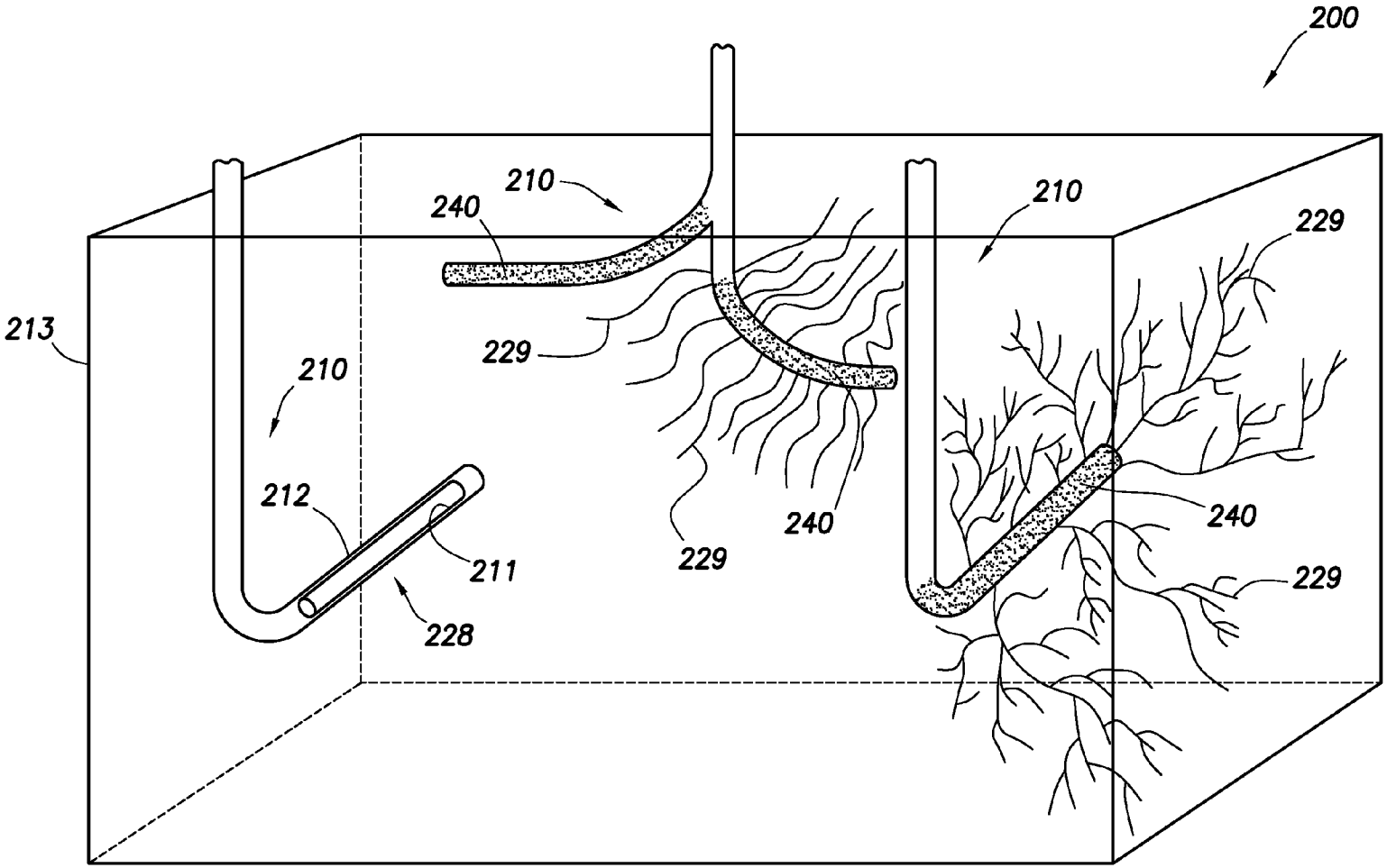
FIG. 2 illustrates an example of an enhanced heavy oil recovery system featuring a distribution of high permeability pathways in a thin reservoir featuring circuitous fluid channels extending from each pathway.

FIG. 2 illustrates an example of an enhanced heavy oil recovery system featuring a distribution of high permeability pathways in a thin reservoir featuring circuitous fluid channels extending from each pathway.

Similar to FIG. 1, FIG. 2 shows wellbores 210 distributed throughout a reservoir, in this case, bitumen reservoir 213. Solvent and/or other fluids may be injected via one or more of wellbores 210 and the resulting mixtures may be withdrawn through one or more wellbores 210 as described above. Here, however, solvent penetrating through bitumen reservoir 213 forms circuitous fluid channels 229 as solvent is forced through the bitumen reservoir. The circuitous nature of fluid channels 229 is due in part to heterogeneity of the downhole geological features and natural bypassing that occurs. In some instances, circuitous fluid channels 229 will form fingers by successive tip-splitting through processes sometimes referred to viscous fingering. Viscous fingering may be encouraged by injecting a fluid with a higher mobility than the mobility of the reservoir fluid. Injection of fluid with high mobility into fluid into a reservoir having a reservoir fluid with a relatively lower mobility promotes the viscous fingering phenomenon. As used herein the term, "mobility ratio," means the ratio of viscosity of the injected fluid over the viscosity of the reservoir fluid is referred to as the mobility ratio. Mobility ratios greater than about one are preferred for promoting viscous fingering. In certain embodiments, mobility ratios greater than about 100 are preferred, whereas in other embodiments, mobility ratios from about 50 to about 100 are preferred, whereas in still other embodiments, mobility ratios greater than about 1,000 are preferred.

As before, portions of wellbores 240 may be packed with high permeability particulate 240. As depicted here, in some instances, high permeability particulate 240 substantially occupies the entire diameter of wellbore 240. In certain embodiments, a portion of one or more of wellbores 210 may be completed with a liner or casing such as slotted liner 211 of supplemental injection wellbore 228.

Many other configurations and distributions of network 200 are possible. In certain embodiments, high permeability pathways are spaced apart at regular distances of about 5 meters to about 25 meters depending on reservoir conditions. In other embodiments, this spacing may vary from about 5 meters to about 50 meters. Wellbores 210 may be arranged in any configuration that economically maximizes recovery of hydrocarbons. Suitable configurations include, but are not limited to, a hub and spoke configuration, a staggered configuration (shown in FIG. 3B), a stacked arrangement (shown in FIG. 3C), or any combination thereof.

FIG. 3A illustrates a perspective view of a plurality of high permeability pathways extending through an oil sand reservoir in accordance with one embodiment of the present invention. Multiple high permeability pathways 312 are shown extending through a pay zone of oil sand reservoir 313. One or more of high permeability pathways 312 may have a plurality of branches 316 extending therefrom. Again, branches 316 enhance the recovery efficiency of system 300. Spacings between adjacent high permeability pathways 312 may vary from about 5 to about 25 meters and from about 5 to about 50 meters in certain embodiments.

As before, one or more high permeability pathways 312 may be used as injection wellbores while one or more other high permeability pathways 312 may be used as production wellbores. In certain embodiments, adjacent high permeability pathways 312 alternate as injection and production wellbores. In other embodiments, each high permeability pathway 312 may alternately serve as an injection and production wellbore.

Where one of the high permeability pathways 312 is used as an injection wellbore for solvent, steam, or any combination thereof, the injection fluid may be left to "soak" for some time afterward (typically not more than a few days). This soaking period allows the solvent, steam, or combination thereof to continue its desired function of reducing the viscosity of the heavy oils in the oil sand reservoir, In this way, energy requirements are reduced in that the solvent, steam, or mixture does not need to be continuously injected during the soak period.

Figure 3B:
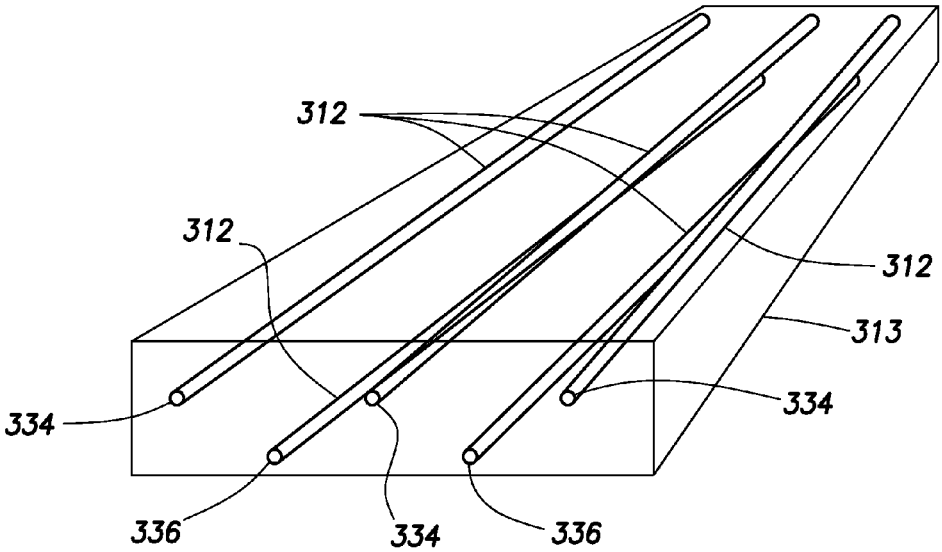
FIG. 3B illustrates a perspective view of a plurality of high permeability pathways shown in a staggered configuration in accordance with one embodiment of the present invention.

FIG. 3B illustrates a perspective view of a plurality of high permeability pathways shown in a staggered configuration in accordance with one embodiment of the present invention. Once again, high permeability pathways 312 are shown extending through an oil sand reservoir 312. Here, high permeability pathways 312 are shown in a staggered configuration. That is, each high permeability pathway 312 is not vertically aligned with each adjacent high permeability pathway 312 so as to achieve the staggered configuration shown. The staggered configuration allows an enhanced coverage in certain oil sand reservoirs 313.

In certain embodiments, each upper high permeability pathway 334 is arranged vertically above each lower high permeability pathway 336. In certain embodiments, upper high permeability pathways 334 are preferred for use as injection wellbores whereas lower high permeability pathways 336 are preferred for use as production wellbores. This vertical separation allows fluids that are introduced via upper high permeability pathways 334 to be influenced by gravity and drawn towards lower high permeability pathways 336 for removal. In this way, steam, solvent, or any combination thereof may be introduced via upper high permeability pathways 334 and withdrawn via lower high permeability pathways 336. Upper high permeability pathways 334 may be situated from about 5 to about 15 meters above lower high permeability pathways 336 in certain embodiments.

Figure 3C:
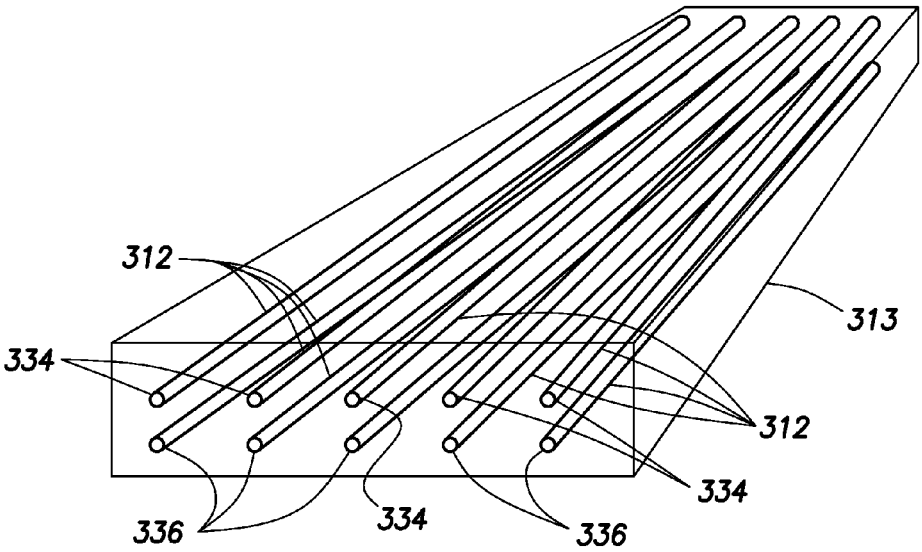
FIG. 3C illustrates a perspective view of a plurality of high permeability pathways shown in a stacked configuration in accordance with one embodiment of the present invention.

FIG. 3C illustrates a perspective view of a plurality of high permeability pathways shown in a stacked configuration in accordance with one embodiment of the present invention. Here, high permeability pathways 312 are shown in a stacked configuration. That is, each high permeability pathway is horizontally and vertically adjacent to neighboring high permeability pathways. The stacked configuration is another configuration that allows an enhanced coverage in certain oil sand reservoirs 313. As before, upper high permeability pathways 334 may be preferred for use as injection wellbores whereas lower high permeability pathways 336 may be preferred for use as production wellbores. Again, the vertical separation gravity to influence introduced fluids to naturally flow from upper high permeability pathways 334 to lower high permeability pathways 336 for removal.

It is explicitly recognized that any of the elements and features of each of the devices described herein are capable of use with any of the other devices described herein with no limitation. Furthermore, it is explicitly recognized that the steps of the methods herein may be performed in any order except unless explicitly stated otherwise or inherently required otherwise by the particular method.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations and equivalents are considered within the scope and spirit of the present invention. Also, the terms in the claims have their plain, ordinary meaning unless otherwise explicitly and clearly defined by the patentee.

What is claimed is:

1. A method for enhancing recovery of bitumen from a thin reservoir comprising the steps of:

establishing a distribution of high permeability pathways in a thin reservoir wherein the step of establishing comprises drilling a plurality of boreholes through the thin reservoir, each borehole having a diameter and each borehole being an openhole, wherein the thin reservoir is nonconsolidated and wherein the thin reservoir has a thickness of less than or equal to about 15 meters;

packing a longitudinal portion of each borehole with a high permeability particulate such that the high permeability particulate substantially occupies the entire diameter of the borehole said high permeability particulate having a mesh size greater than about 500 microns;

wherein at least one of the high permeability pathways comprises an injection wellbore;

wherein at least one of the high permeability pathways comprises a production wellbore;

introducing a solvent into the injection wellbore;

allowing the solvent to flow into the thin reservoir and mix with the bitumen to form a mixture of the bitumen and the solvent;

withdrawing the mixture from the thin reservoir from the production wellbore;

conditioning the thin reservoir over a period of time by allowing a continuous fluid circulation to develop from the injection wellbore to the production wellbore; and after the step of conditioning the thin reservoir, continuously introducing the solvent into the thin reservoir by way of at least one of the high permeability pathways the while simultaneously withdrawing the mixture from the thin reservoir.

2. A method for enhancing recovery of bitumen from a thin reservoir comprising the steps of:

establishing a plurality of high permeability pathways that traverse at least partially through the thin reservoir, wherein the thin reservoir is nonconsolidated and wherein the thin reservoir has a thickness of less than or equal to about 15 meters;

wherein each high permeability pathway comprises a borehole, wherein the borehole is substantially packed with high permeability particulate said high permeability particulate having a mesh size greater than about 500 microns;

introducing a solvent into one of the high permeability pathways;

allowing the solvent to flow into the thin reservoir and mix with the bitumen to form a mixture of the bitumen and the solvent; and withdrawing the mixture from the thin reservoir from one of the high permeability pathways.

3. The method of claim 2 wherein a mobility ratio of the solvent and the bitumen is greater than about 50.

4. The method of claim 3 wherein a mobility ratio of the solvent and the bitumen is greater than about 1,000.

5. The method of claim 3 wherein a mobility ratio of the solvent and the bitumen is from about 50 to about 100.

6. The method of claim 2:

wherein at least one of the high permeability pathways comprises an injection wellbore;

wherein at least one of the high permeability pathways comprises a production wellbore;

wherein the step of introducing the solvent comprises introducing the solvent into the injection wellbore; and wherein the step of withdrawing the mixture comprises withdrawing the mixture from the production wellbore.

7. The method of claim 6 further comprising the step of establishing continuous fluid communication between the injection wellbore and the production wellbore.

8. The method of claim 6 further comprising the step of recovering the solvent from the mixture by separating the solvent from the mixture, wherein the step of separating comprises introducing the mixture to a flash drum and allowing the mixture to separate into a liquid stream and a vapor stream, wherein the vapor stream is a solvent-enriched stream.

9. The method of claim 8 further comprising recycling the solvent by reintroducing the solvent into the thin reservoir.

10. The method of claim 6 wherein the injection wellbore is the production wellbore.

11. The method of claim 10 further comprising repeating and alternating the steps of introducing and withdrawing so as to cyclically introduce solvent into the thin reservoir followed by withdrawal of the mixture of solvent and bitumen.

12. The method of claim 11 wherein the step of introducing the solvent and the step of withdrawing the mixture both occur through a single high permeability pathway.

13. The method of claim 2 wherein the step of withdrawing the mixture occurs after the step of introducing the solvent.

14. The method of claim 2 wherein the borehole is an openhole, wherein establishing the high permeability pathways comprises drilling a plurality of boreholes through the thin reservoir and substantially packing the boreholes with the high permeability particulate such that the high permeability particulate occupies an entire diameter of the borehole.

15. The method of claim 14 further comprising establishing a plurality of circuitous fluid channels extending from each of the high permeability pathways into the thin reservoir.

16. The method of claim 15 wherein the step of establishing the plurality of fluid channels comprises forcing solvent to flow from the high permeability pathways into the unconsolidated thin reservoir.

17. The method of claim 2 wherein the solvent is a aliphatic hydrocarbon having 4 carbons to 30 carbons, naptha, syncrude, diesel, an aromatic solvent, toluene, benzene, xylene, or any combination thereof.

18. The method of claim 17 further comprising introducing a surfactant into the injection wellbore.

19. The method of claim 2 wherein the high permeability particulate is gravel having a mesh size greater than about 500 microns.

20. The method of claim 19 wherein the high permeability particulate is gravel having a mesh size greater than about 1,000 microns.

21. The method of claim 2 further comprising the step of applying heat to the thin reservoir to reduce the viscosity of the bitumen.

22. The method of claim 21 wherein the step of applying heat comprises introducing steam to the thin reservoir through the injection wellbore.

23. The method of claim 22 wherein the steam and the solvent are introduced simultaneously through the injection wellbore.

24. The method of claim 2 wherein a plurality of the high permeability pathways each comprise a supplemental injection wellbore.

25. The method of claim 2 wherein a plurality of the high permeability pathways each comprise a supplemental production wellbore.

26. The method of claim 2 wherein the thin reservoir has a thickness of about 2 meters to about 15 meters.

27. The method of claim 2:

wherein a portion of the injection wellbore is deviated from the vertical;

wherein a portion of the production wellbore is deviated from the vertical;

wherein both the injection wellbore and the production wellbore each have a diameter;

wherein high permeability particulate fills the entire diameter of both the injection wellbore and the production wellbore along the portion of the injection wellbore and along the portion of the production wellbore; and wherein the portion of the injection wellbore and the portion of the production wellbore traverse a portion of the thin reservoir.

28. The method of claim 2 wherein each high permeability pathway is spaced about 5 to about 25 meters from adjacent high permeability pathway.

29. The method of claim 2 wherein the high permeability pathways are arranged in a hub and spoke configuration.

30. The method of claim 2 wherein the high permeability pathways are arranged in staggered configuration.

31. The method of claim 2 wherein the high permeability pathways are arranged in a stacked configuration.

32. A method for enhancing recovery of heavy oil from an oil sand reservoir comprising the steps of:

establishing a plurality of high permeability pathways that traverse at least partially through the oil sand reservoir, wherein the thin reservoir is nonconsolidated and wherein the oil sand reservoir has a thickness of less than or equal to about 15 meters;

wherein each high permeability pathway comprises a borehole, wherein the borehole is substantially packed with high permeability particulate said high permeability particulate having a mesh size greater than about 500 microns;

wherein at least one of the high permeability pathways comprises an injection wellbore;

wherein at least one of the high permeability pathways comprises a production wellbore;

introducing a solvent into the injection wellbore;

allowing the solvent to flow into the oil sand reservoir and mix with the heavy oil to form a mixture of the heavy oil and the solvent;

withdrawing the mixture from the production wellbore; and establishing continuous fluid communication between the injection wellbore and the production wellbore.

33. The method of claim 32 wherein the solvent has a solvent viscosity, wherein the heavy oil has a heavy oil viscosity, wherein a mobility ratio is the solvent viscosity over the heavy oil viscosity, and wherein the mobility ratio is greater than about 1,000 so as to promote viscous fingering of the solvent through the heavy oil.

* * * * *